United States Patent [19]

Donan, Jr.

[11] 4,453,845

[45] Jun. 12, 1984

[54] BASE THRUST ANCHOR SHELL ASSEMBLY

[76] Inventor: David C. Donan, Jr., Rte. 1, Rainwater La., Manitou, Ky.

[21] Appl. No.: 459,191

[22] Filed: Jan. 19, 1983

[51] Int. Cl.[3] ..... E21D 20/00; E02D 5/74

[52] U.S. Cl. ..... 405/259; 52/161; 411/21; 411/39

[58] Field of Search ..... 405/259-262, 405/244; 52/155-165; 411/15-24, 58-62, 39

[56] References Cited

U.S. PATENT DOCUMENTS

| | | | |
|---|---|---|---|
| 814,229 | 3/1906 | McGillivary | 52/161 |
| 1,600,428 | 9/1926 | Robinson | 52/160 |
| 1,606,146 | 11/1926 | Cole et al. | 52/161 |
| 1,606,147 | 11/1926 | Cole et al. | 52/161 |
| 2,217,271 | 10/1940 | Handel | 52/161 |
| 2,491,564 | 12/1949 | Iversen | 114/311 |
| 2,771,746 | 11/1956 | Fischer et al. | 405/259 X |
| 2,854,824 | 10/1958 | Curry et al. | 405/259 |
| 3,304,828 | 2/1967 | Karhu | 411/21 |
| 3,312,138 | 4/1967 | Cumming | 411/21 |
| 4,189,879 | 2/1980 | Patterson | 52/161 |

FOREIGN PATENT DOCUMENTS

| | | | |
|---|---|---|---|
| 39579 | 6/1887 | Fed. Rep. of Germany | 52/161 |

*Primary Examiner*—Dennis L. Taylor

*Attorney, Agent, or Firm*—James R. Higgins, Jr.

[57] ABSTRACT

Base thrust anchor assembly for use with roof bolts and base plate having means to provide deep penetration of the rock strata and provide large areal distribution of the longitudinal load in order to prevent overstressing the rock strata. The assembly employs anchor wings having a small longitudinal cross-sectional area that is applied in a transverse (radial) direction to permit deep penetration of the strata of a bolt hole wall, and a large transverse cross-sectional area to better support the longitudinal load imposed on the rock strata.

10 Claims, 31 Drawing Figures

BASE THRUST ANCHOR SHELL ASSEMBLY

BACKGROUND AND NECESSITY OF THE INVENTION

Roof bolts with base plate and anchor shells are used extensively in mining and tunneling operations to reinforce and support weak rock strata. The invention herein disclosed relates to such roof bolting.

When tunneling or mining minerals in soft strata, it is necessary to shore up the roof of any underground passageway. This is normally accomplished by "bolting" the roof strata, a process well known in the art.

The conventional roof bolt anchor shell assembly is generally disclosed in the U.S. Pat. No. 2,783,673 issued to W. J. Lewis, et al. While certain refinements have since been added, such as those disclosed in U.S. Pat. No. 3,022,700 issued to J. B. Dempsey, most of the presently available mine roof bolts employ a threaded wedge nut to advance down a threaded shank. As the threaded shank is rotated, the wedge nut engages and expands an outer expansion shell unit into the wall of a previously drilled bolt hole. This outer expansion creates compressive or lateral stress and compresses the strata between the anchor shell and the base plate of the bolt assembly, which provides a safer mine roof, less susceptible to sagging.

Currently available roof bolts, however, are deficient in that the maximum expansion of the expansion shell is limited by the radial distance between the inner edge of the wedge nut and the outer edge of the base of the wedge nut, while presenting a relatively large area to provide transverse (compressive) thrust. Such limited radial expansion of conventional expansion shells provides transverse force applied over a large area, rather than a concentration of force (pressure) in a small area which would best provide deep penetration of the strata of the bolt hole wall.

If deeper penetration affording a greater area for support of the longitudinal load can be provided, a more appropriate and safer vertical force can be applied to the mine roof, which makes the bolting process much more effective. One method to provide such deeper penetration is disclosed in U.S. Pat. No. 3,192,822 issued to A. H. Genter. However the Genter method generally requires too much strata to be broken up before adequate anchoring can be obtained, if at all. A better device to obtain deep penetration without breaking up too much strata is disclosed in my earlier U.S. Pat. No. 4,293,244, Pick Arm Anchor Assembly, which provides a decided advantage over conventional roof bolt expansion shell systems. However, the present invention yields even deeper penetration of the roof strata (particularly in soft to medium-hard strata such as shale)—even more than provided by my Pick Arm Anchor Assembly—and represents a substantial advance in the state of the roof bolting art.

SUMMARY OF THE INVENTION

Mine roof bolt assemblies are employed in mining and tunneling operations to: [1] Support weak strata by anchoring it to more firm strata in order to prevent strata movement, and [2] for anchoring purposes where no firm strata is present, to compress layered strata to prevent lateral strata movement (i.e., sagging). After bolting, the compressed strata essentially comprise a laminated beam to strengthen the weaker strata and support overburden.

The present invention, Base Thrust Anchor Shell Assembly, provides deeper penetration of the rock strata than conventional anchors by concentrating radial strata by overstressing from the longitudinal anchor load. In other words, presently available roof bolting systems permit the longitudinal stress resistance of the rock strata to be exceeded by the load (pressure) applied to the hanging surface of the roof bolt. In contrast, the Base Thrust Anchor Assembly distributes the vertical load over a significantly wider area which reduces the unit load on the roof bolt, significantly reducing the possibilities of strata failure, and greatly increasing the safety of the mine roof.

BRIEF DESCRIPTION OF THE DRAWINGS

FIG. 8 shows the comparative penetration factors of conventional expansion wings (A) compared to the present invention (B);

DETAILED DESCRIPTION OF THE PREFERRED EMBODIMENT

Figure 1:
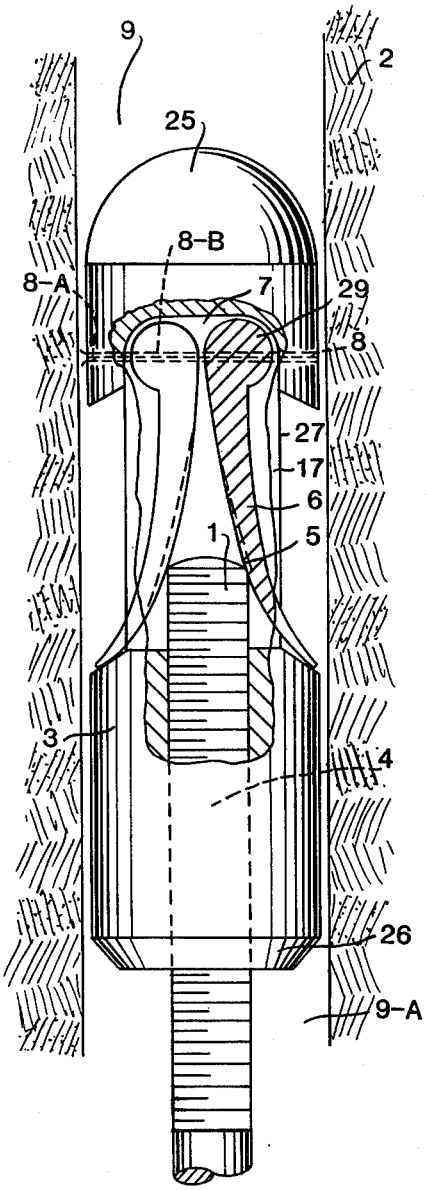
FIG. 1 is a Cross-Sectional View of the present invention as installed in a bolt hole before the expansion wings are expanded.
Figure 2:
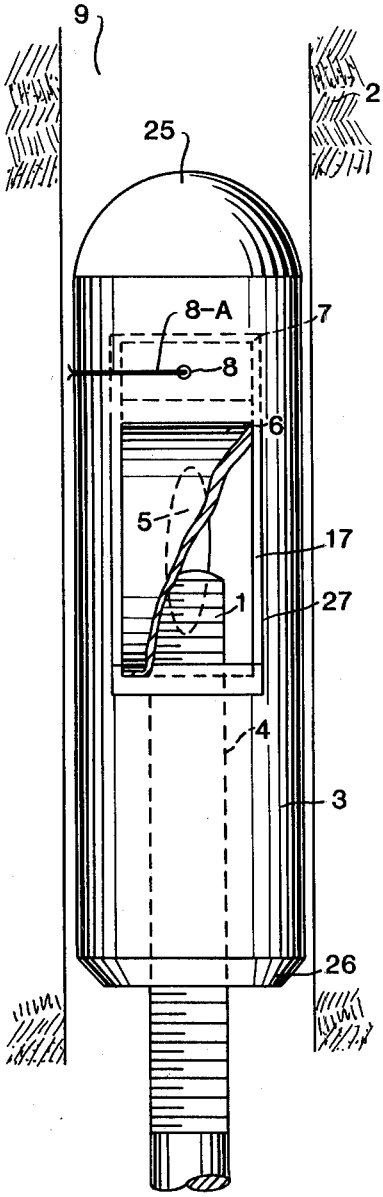
FIG. 2 is a Cross-Sectional View of the present invention from the front, as installed in a bolt hole.
Figure 3:
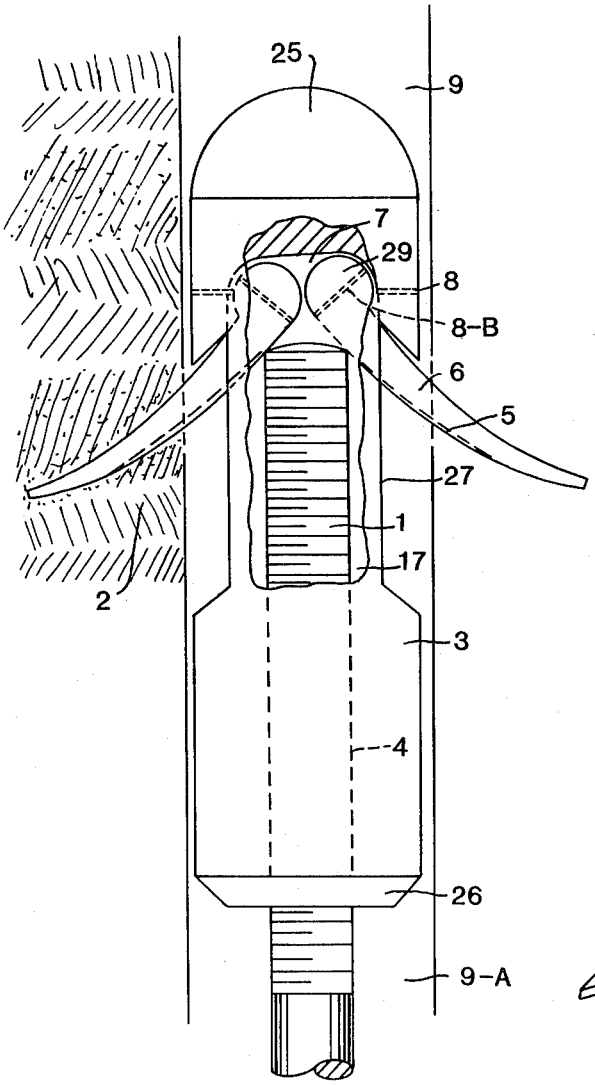
FIG. 3 is a Cross-Sectional View of the present invention from the side, the same view as FIG. 1, after the expansion wings have been expanded into the wall of the bolt hole.
Figure 5:
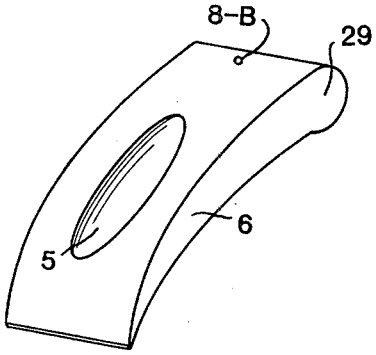
FIG. 5 is a perspective view of the bottom side of an expansion wing of the present invention.
Figure 4:
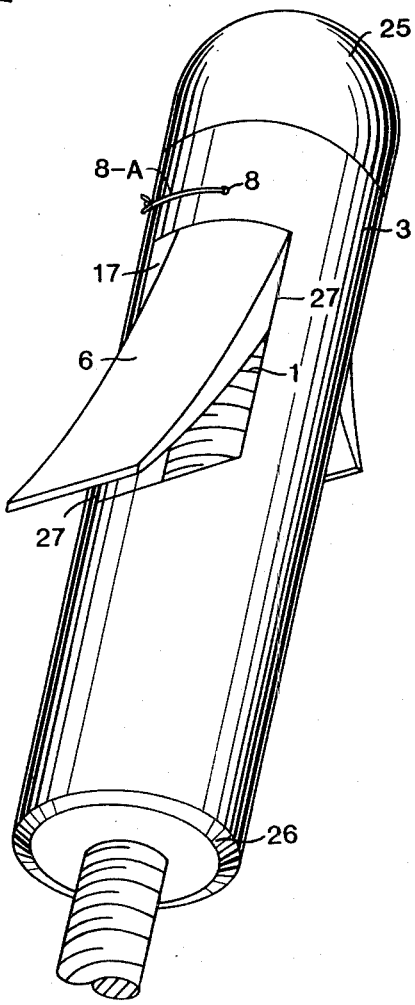
FIG. 4 is a perspective view of the present invention.
Figure 7C:
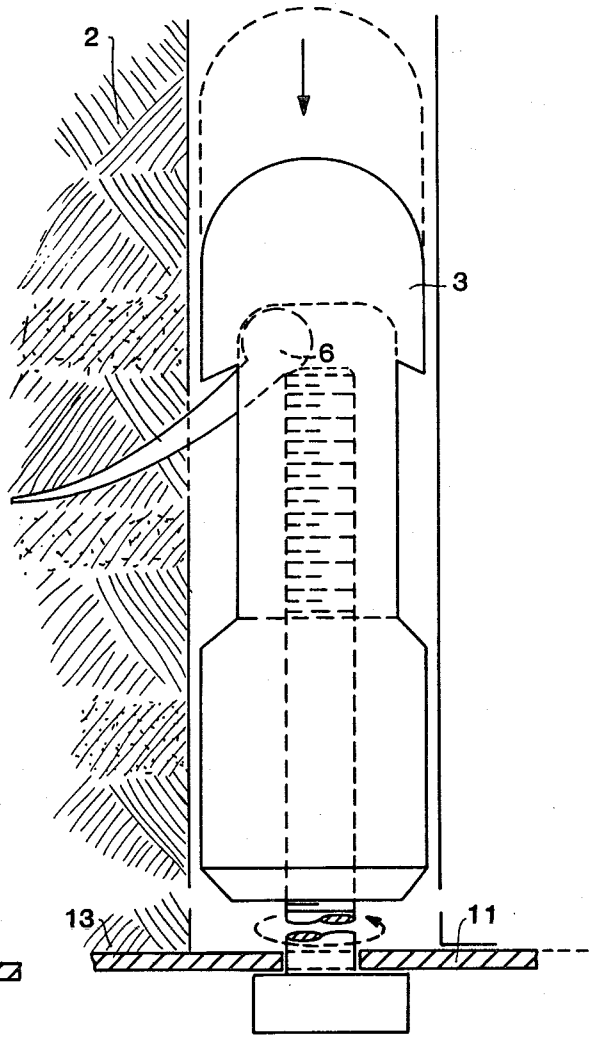
FIG. 7 is an illustration showing, in three (3) successive steps, how rotation of the roof bolt causes the expansion shell of the present invention to move downward, causing the expansion wings to move outwardly into the roof strata.
Figure 7B:
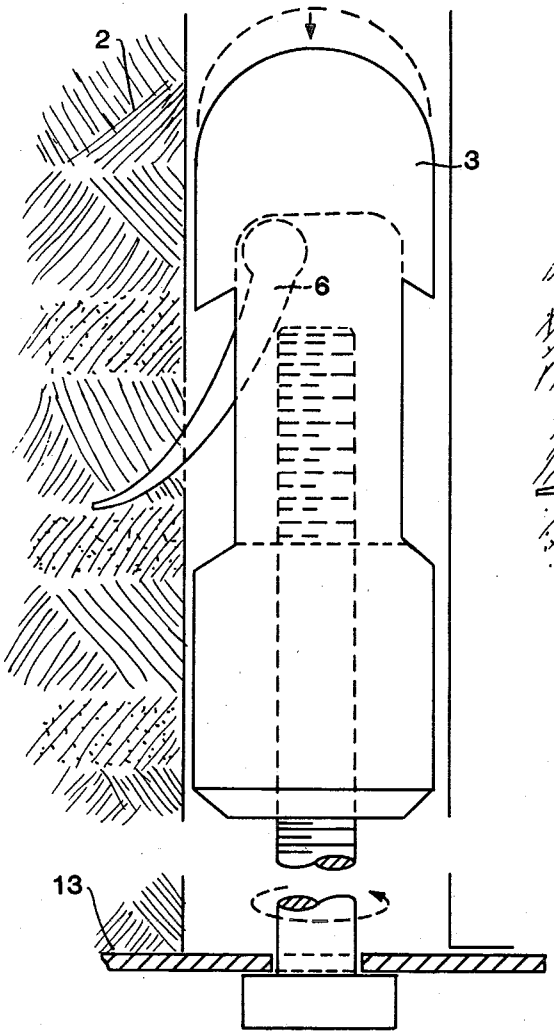
Figure 7A:
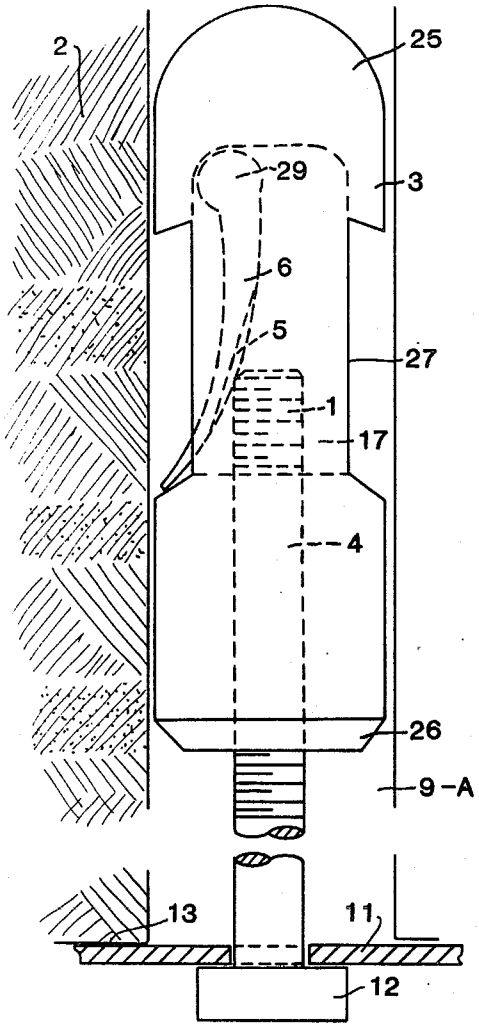
Figures 1, 8A:
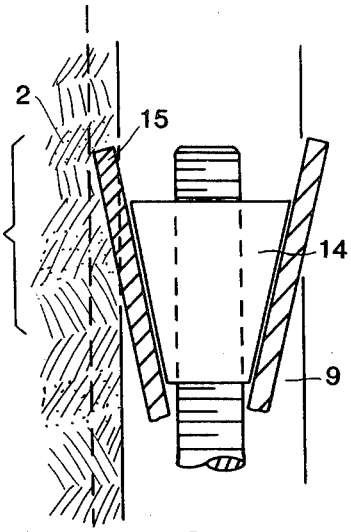
Figures 1, 8B:
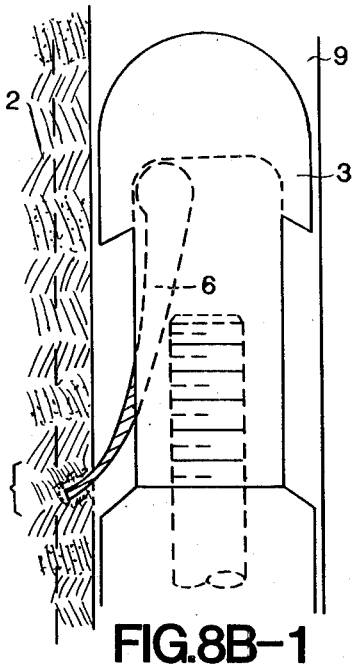
Figures 2, 8A:
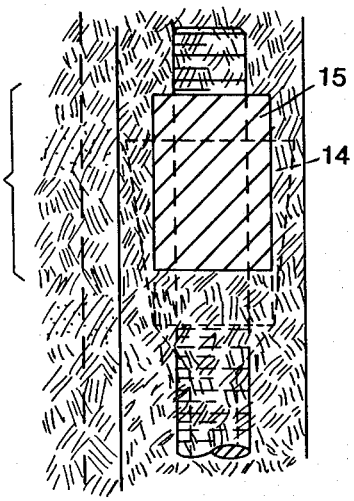
Figures 2, 8B:
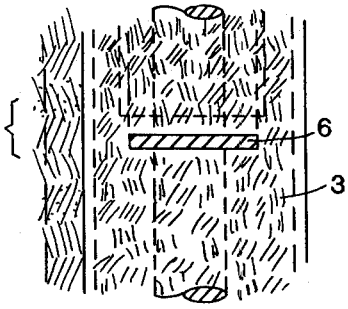
Figures 3, 8A:
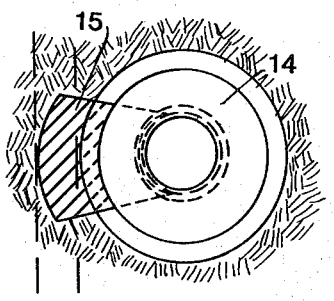
Figures 3, 8B:
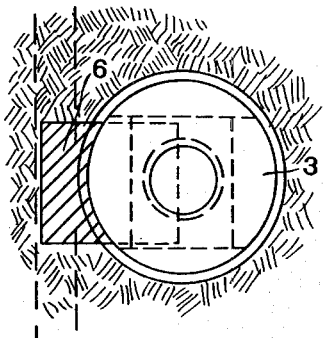

The present invention, Base Thrust Anchor Assembly comprises an anchor shell 3, two or more expansion wings 6, and a binder wire 8-A, as shown in more detail in FIGS. 1, 2, and 4. The base thrust anchor assembly is used in connection with a conventional rock/roof bolt having a threaded upper end 1 and a bolt head 12. The present invention perhaps is best practiced in combination with a conventional base plate 11 as shown in FIG. 7, but the Base Thrust Anchor Assembly herein disclosed, will work without a base plate.

DESCRIPTION OF THE PARTS

Shell—the shell 3 (FIGS. 1, 2, 3 and 4) is cylindrical in shape, with its upper outside end 25 rounded in a semi-cylindrical fashion to facilitate insertion of the assembly into a bolt hole 9-A. The lower outside end of the shell, 26, is beveled inward to facilitate shell movement in the bolt hole 9-A. The shell 3 has an interior shaft, 17, 7, extending longitudinally from the lower end 26 to a point near the upper end 25. The shell 3 is threaded 4 in the lower portion thereof to receive a threaded roof bolt 1. The central portion of the interior open shaft, 17 and 7, has an enlarged portion 17, adapted to receive the expansion wings 6 of the present invention. In proximity to the enlarged portion 17, the shell 3 is provided with a rectangular aperture 27, to permit the expansion wings 6 to exit the shell 3 on two sides, as explained in more detail below. The upper portion of the interior shaft 7 is formed into a cavity whose sides are semi-circular, each adapted to receive one expansion wing head 29. The cavity 7 forms the terminus of the interior shaft 17 and 7, and embrace the rounded heads 29 of the expansion wings 6. The upper end of the shell 3 is provided with a second aperture 8 extending through both sides of shell 3, and alignable with apertures 8-B in the heads 29 of the expansion wings 6 and adaptable to receive flexible binder wire 8-A which is used to retain the expansion wings 6 within the enlarged portion 7 of the shaft 17 and 7 prior to using the Base Thrust Anchor Shell Assembly. The aperture 8 may also be used to receive the mounting hooks 18 of the alternate configuration of the expansion wings as discussed in more detail below and shown in FIGS. 9 and 10.

Figure 11:
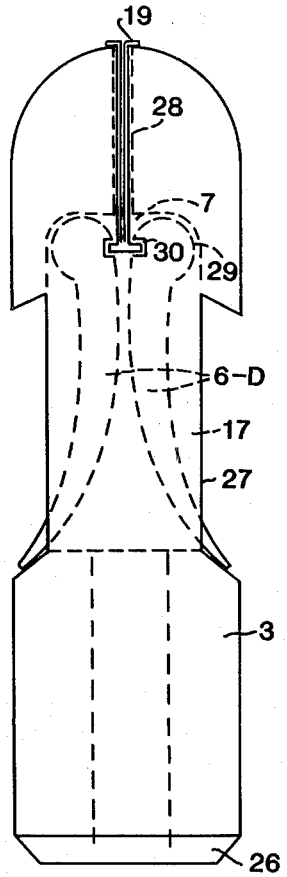
FIG. 11 shows another alternative embodiment (sectional view) of an expansion wing with a split-head fastener.

An alternate embodiment of the shell is disclosed in FIG. 11. This embodiment is provided with an aperture 28 extending longitudinally through the center of the upper end of the shell 3 and connected to the wing cavities 7. Aperture 28 serves to receive a split-head fastener 19, which is used in lieu of binder wire 8-A when the alternate wings with split-head slots 6-D are employed.

Figure 17:
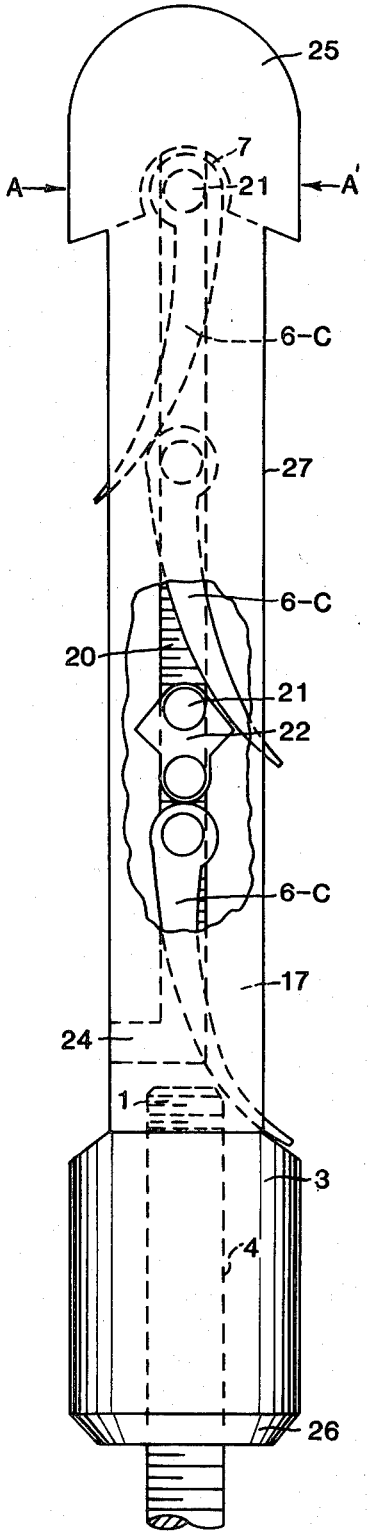
FIG. 17 shows a sectional view of an another alternate embodiment of the present invention, utilizing multiple expansion wings and variable-length spacers between expansion wings.
Figure 18:
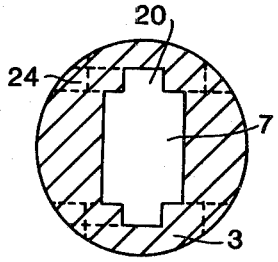
FIG. 18 shows a sectional view, taken along line A—A of FIG. 17.
Figure 19:
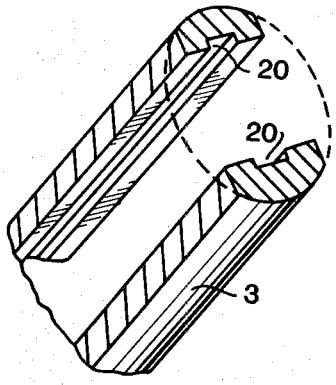
FIG. 19 shows a perspective view of a portion of the alternate embodiment depicted in FIG. 17.

Another alternate embodiment of the shell is disclosed in FIG. 17. This embodiment is provided with channels 20 located longitudinally, one on each side of the shell 3 extending from the threaded section 4 up into the cavity 7 in the upper part of shell 3. FIG. 18 is a top sectional view of the shell with channels 20. FIG. 19 shows a perspective view of the channels 20 in a portion of the shell 3. The channels 20 receive the studs 21 of the expansion wings 6-C and spacers 22. Another channel 24 located on each side of the shell 3 near the base of the open shaft 17 extends radially outward from the longitudinal channel 20 and provides a means for insertion of the studs 21 of both the expansion wings 6-C and the spacer 22 into the longitudinal channels 20 so that the expansion wings 6-C and the spacers 22 are within the open shaft 17 and 7. This embodiment permits the use of multiple expansion wings with the shell 3, and also permits variable spacing between the expansion wings longitudinally by means of spacers 22. These spacers 22 may be provided in various lengths longitudinally. The upper part of the spacer is provided with flat sloping surfaces with a stud projecting transversely from each end. The lower shank portion also has a stud projecting transversely from each end.

Expansion Wings—The expansion wings 6 of the disclosed device are provided with a long slightly curved and tapered shank and with curved upper and lower surfaces and a cylindrical head 29 at the upper end. The cylindrical head 29 is adaptable to fit into the upper end of cavity 7. The center of the bottom (back) surface of the expansion wing 6 has a recessed cam groove 5 or channel to receive the upper end of the threaded rock/roof bolt 1, which cam groove 5 extends longitudinally for a substantial portion of the length of the expansion wing 6. The rounded head 29 of the expansion wing 6 fits into a cavity 7 in the upper end of the interior open shaft 17 of the shell 3. The cam groove 5 provides a guide or camming surface to keep the upper end of the roof bolt 1 engaged to the expansion wings 6.

In use, as the rock/roof bolt 1 is rotated in the threaded portion 4 of shell 3, the shell 3 advances down the bolt 1 until the bolt 1 comes into contact with the cam groove 5 of the expansion wings 6. Continued contact of bolt 1 with the cam groove 5 causes the expansion wing heads 29 to rotate in cavity 7, which forces the shank of the expansion wings 6 outward radially through the apertures 27 and into contact with the inner strata surface 9 of the inner wall of the bolt hole.

Figure 9:
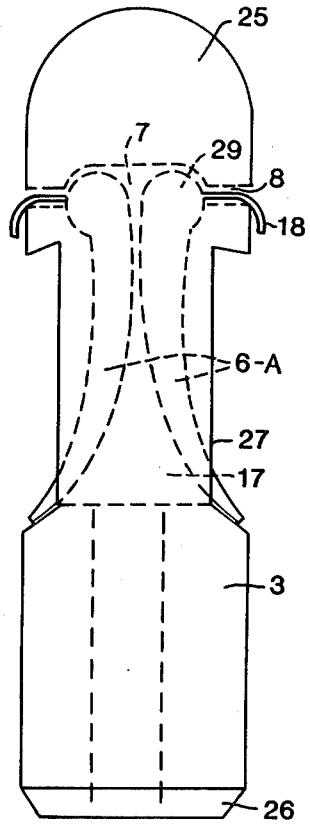
FIG. 9 shows an alternate embodiment, in sectional view, of the expansion wings of the disclosed invention.
Figure 10:
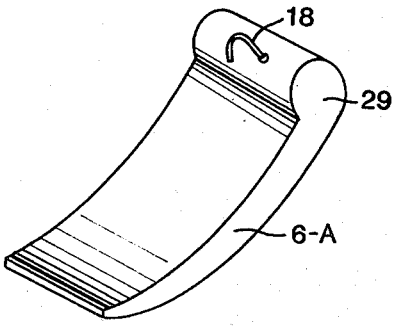
FIG. 10 shows another alternative embodiment of an expansion wing with a mounting hook, in perspective view.

An alternate embodiment of the expansion wings is disclosed in FIGS. 9 and 10, with mounting hooks 18 to hold the expansion wings 6 together prior to using the disclosed device. The mounting hooks 18 are inserted through the apertures 8 in the upper end of the shell cavity 7, instead of using binder wire 8-A. Another embodiment is disclosed in FIG. 11. It is adapted to use with a split-head fastener 19, in lieu of the binder wire 8-A or mounting hooks 18. In this embodiment, the expansion wings 6-D are fitted with a slot 30 to receive the head portion of the split-head fastener 19 between the two wings 6-D.

Figure 14:
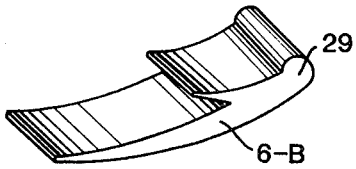
FIG. 14 shows an expansion wing with multiple contact tips.
Figure 15:
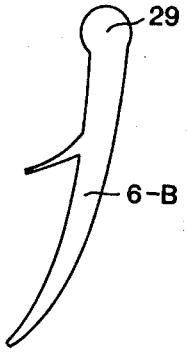
FIG. 15 shows a sectional view of the multiple contact tip expansion wing.
Figure 22A:
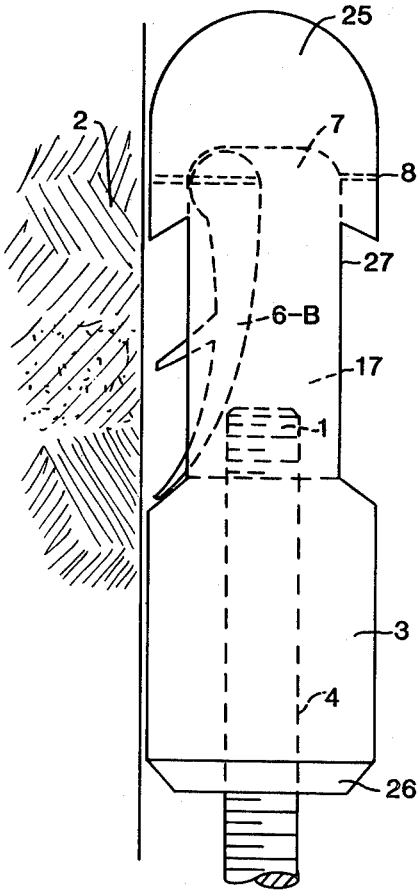
FIG. 22 shows a sectional view of the presently preferred embodiment utilizing the alternate multiple contact tip expansion wings disclosed in FIGS. 14 and 15, the assembly shown before expansion (A) and after expansion (B).
Figure 22B:
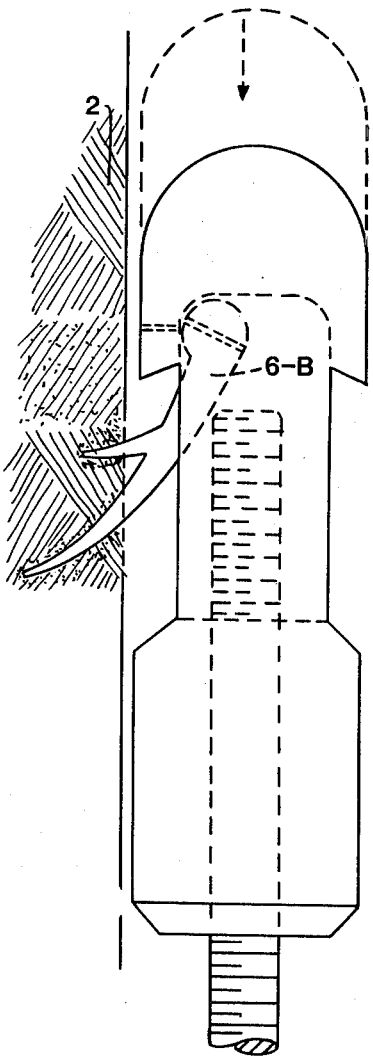

Another alternate embodiment is disclosed in FIGS. 14 and 15. It is adapted to use multiple strata contact tips on the expansion wings 6-D. FIG. 22 shows the multiple strata contact tips before expansion (A), and after expansion (B) in the bolt hole.

Figure 20:
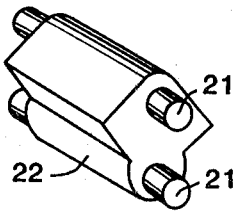
FIG. 20 shows a perspective view of the spacer depicted in FIG. 17.
Figure 21:
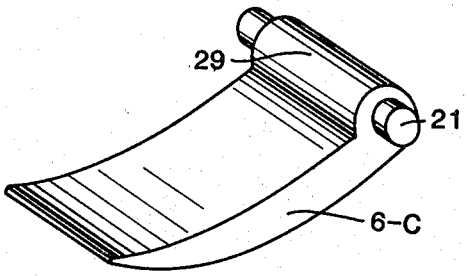
FIG. 21 is a perspective view of the expansion wing of the alternate assembly disclosed in FIG. 17.

Another alternate embodiment is disclosed in FIG. 17 and FIG. 20 and FIG. 21. This embodiment using expansion wings 6-C which has studs 21 on each end of the rounded head 29 to fit in channel 20 is adopted for use with the alternate embodiment of the shell 3 as shown in FIG. 17 which permits the use of multiple expansion wings 6-C and variable spacing of the wings, longitudinally, employing spacers 22 between the expansion wings 6-C when assembled in the shell 3.

Figure 13:
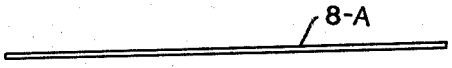
FIG. 13 shows the binder wire that may be used in the present invention.

Binder wire—A soft malleable wire 8-A also shown in FIG. 13 is employed to retain the expansion wings 6 in position within the shell 3 during shipment and handling until such time as the anchor shell assembly is actuated within the bolt hole 9.

Assembly—Prior to use in the field, the Base Thrust Anchor Assembly is easy to assemble. The expansion wings 6 are inserted into the open shaft or chamber 17 of the anchor shell 3 with their upper rounded heads 29 positioned into the cavities 7 of the shell 3. A flexible binder wire 8-A is then inserted through aperture 8 on one side of the upper end of the shell 3, through the apertures 8-B of each expansion wing, then exiting from the aperture 8 on the second side of the shell 3. The wire 8-A is then twisted around the shell 3 in order to retain the wings 6 in position. The shell 3 with wings 6 attached is then inserted onto the threaded end 1 of the rock/roof bolt, and screwed on the bolt 1 until the upper end of the bolt 1 comes into contact with the cam groove 5 of each expansion wing 6. If the alternate embodiment using the split-head fastener is used (FIG. 11) the head of the split-head fastener 19 is inserted into head slots 30 of the expansion wings 6-D, and then the wings 6-D and fastener 19 are all inserted as a group into the cavities 7, with the blades of the fastener inserted through the aperture 28 in the top portion of the shell 3. After insertion, the blades of the split-head fastener 19 extend out from the top of the shell 3, and are bent to retain the assembly together.

If the alternate embodiment of the expansion wings with mounting hooks 6-A is used (FIG. 9), the expansion wings 6-A are inserted into the chamber, or open shaft 17 and the mounting hooks 18 are inserted through the apertures 8 in the shell 3.

If the alternate embodiment using multiple expansion wings (FIG. 17) is used, the studs 21 of one end of the expansion wing 6-C are insert into the channel entrance 24 until they engage the channels 20 on each side of the shell 3, by way of the channel entrance 24, the expansion wing 6-C is then advanced up the chamber 17 with the studs sliding up the longitudinal channels 20 until the studs 21 and the rounded head 29 engage the upper cavity 7 in the head of the shell 3; next the spacer 22 and or additional expansion wings 6-C and spacers 22 are inserted into the shell 3 in a similar manner. After the expansion wings 6-C and spacers 22 are in the shell 3 the assembly is then threaded onto the end of rock/roof bolt 1 by engaging the threaded section 4 of shell 3, until the end of the bolt 1 comes in contact with the under side of the bottom (lowermost) expansion wing 6-C.

Operation—Examination of the various drawings, especially FIGS. 1 and 4, and the above specification reveals that the present invention can be practiced with only the components of the shell 3, one or more expansion wings 6, binder wire 8-A, and a roof bolt 1. However, as shown in FIG. 7, employing a base plate 11 in contact with the mine roof face 13 enhances the effectiveness of the present invention because it enables the roof strata to be placed more in compression. Also, by using an appropriate roof bolt hole gasket (not shown), the base plate can prevent air and/or moisture and/or mining gases from entering the roof bolt hole. As is well known in the art, moisture, air or mining vapors can be detrimental to strata integrity and can also cause corrosion of the anchoring components.

Figure 6A:
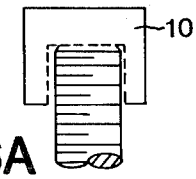
FIG. 6 is a view of the Wedge Cap of an alternate embodiment of the present invention, showing same from the front (A) side (B) and in perspective (C)
Figure 6B:
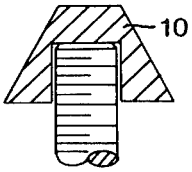
Figure 6C:
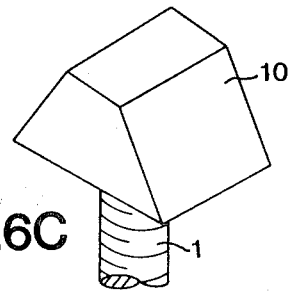

After assembling the unit as described above, the roof bolt 1, with base plate 11 and the base thrust anchor shell assembly 3, 6, 8-A is inserted into a bolt hole (9-A) until the base plate 11 comes in contact with face of the roof 13. See FIG. 7. The roof bolt shank 1 is then manipulated to one side of the hole 9-A so that one expansion wing 6 of the Base Thrust Anchor Shell Assembly engages the corresponding inner wall 9 of the bolt hole. The bolt 1 is then rotated. Since the threads of the bolt 1 are in contact with the inner threaded portion 4 of the shell 3, this causes the anchor shell assembly to retract longitudinally toward the base plate 11, as shown in sequence in FIGS. 7. As the threaded end of the bolt 1 contacts the cam groove surface 5 on the underside of the expansion wings 6, the expansion wings 6 are forced outward transversely (radially). As the shell assembly [3, 6, 8-A] retracts downwardly, the expansion wings 6 are implanted in the roof strata 2 simultaneously, the intervening strata 2 between the anchor shell assembly [3, 6, 8-A] and base plate 11 is compressed, thereby strengthening the layered roof strata. In harder roof strata, it may be desirable, as an alternate means, to employ a wedge cap 10 (FIG. 6) to provide additional contact surface to distribute the load (pressure) more evenly from the rock/roof bolt 1 to the expansion wings (6). This would prevent possible seizure of the threaded bolt 1 in the threaded section 4 of shell 3, or possible bending of the rock/roof bolt 1.

Figure 12:
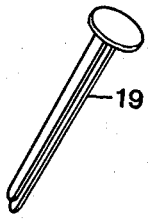
FIG. 12 shows a perspective view of a split-head fastener.

A alternate embodiment for holding the anchor shell assembly together is also disclosed in FIGS. 9 and 10, employing a mounting hook 18 attached to the expansion wing. Another alternate configuration for holding the anchor shell assembly together employing a split-head fastener 19 is shown in FIGS. 11 and 12.

The basic Base Thrust Anchor Shell Assembly can be provided with several features which can enhance its anchoring effectiveness.

In FIGS. 14 and 15, a dual-tipped expansion wing 6-B is disclosed. The dual-tipped expansion wing provides the advantage of penetration at different rock/roof strata levels, as shown in FIG. 22. By providing two penetration tips, at different entry planes of the strata, less damage to a single plane of roof strata is incurred during the bolting process, resulting in a safer roof. In designing and positioning, the dual penetration tips of wings 6-B care must be taken to locate the smaller tip at a location to permit contact with and penetration of the rock strata without colliding with the body of the shell at the top of aperture 27.

Figure 16:
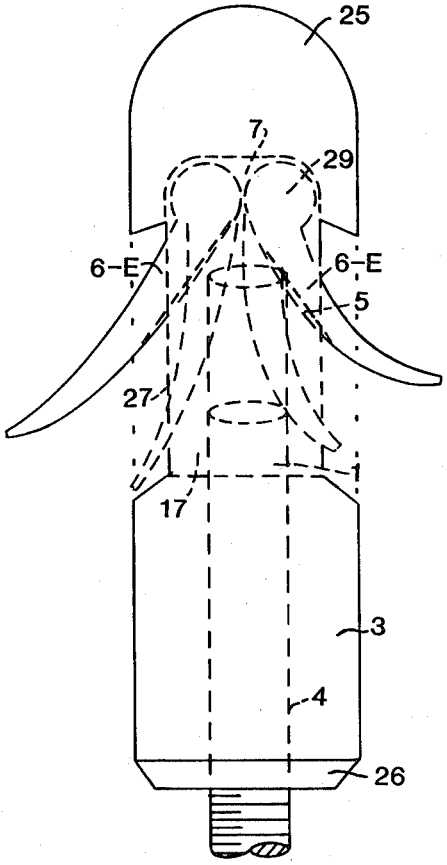
FIG. 16 shows a sectional view of an alternate embodiment of the present invention, utilizing expansion wings of varying lengths.

Another method of providing different penetration planes is disclosed in FIG. 16. In this embodiment, the expansion wings 6-E are of different lengths. This embodiment not only provides for penetration at different horizontal planes at differing vertical levels, but provides such on different sides of the anchor shell. This has the advantage of varying strata stress points along the vertical axis of the Base Thrust Anchor Shell Assembly.

Yet another embodiment of the present invention is disclosed in FIG. 17. This embodiment combines the features of the prior embodiments disclosed in FIGS. 3, 16, and 22, and permits penetration of the rock strata at differing horizontal planes at differing vertical levels as well as avoiding penetration at the same plane but merely on opposite sides of the shell. This embodiment can be used with or without spacers 22. Spacers 22 can also be of varying lengths to provide penetration at different levels of strata. It should also be pointed out that the design of the spacer 22 serves the same function as the wedge cap 10 disclosed in FIG. 6.

Materials—Preferred materials for construction of all embodiments of the disclosed invention [except the malleable wire 8-A] is steel, in conformance with ANSI/ASTM Specifications F432 "Roof and Rock Bolts and Accessories".

I claim:

1. Base Thrust Anchor Shell Assembly, comprising in combination:

a bolt having a threaded shank for insertion in a bolt hole having a threaded upper end and a lower end adapted to permit rotation of said roof bolt;

a bolt base plate of sufficient dimensions to cover said bolt hole and having an aperture therethrough adaptable to receive said bolt and alignable with the vertical axis of said bolt hole;

an elongated shell adaptable for insertion into said bolt hole having a first lower end adaptable to receive said threaded bolt and a second upper end having apertures therethrough adaptable to receive fastening means, and having an interior cavity extending substantially the full length of said elongated shell having a first lower threaded portion adaptable to receive said threaded bolt and an upper second portion having a terminus in proximity to said second upper end adaptable to receive one or more expansion wings and alignable with said apertures of said second upper end of said elongated shell, and having central exit apertures positioned between said first lower end and said second upper end of said elongated shell on opposite sides of the central portion of said elongated shell adaptable to permit said expansion wings to exit therethrough;

one or more expansion wings having a first end adaptable to be received in said terminus of said interior cavity of said elongated shell and having fastening apertures alignable with said apertures of said second upper end of said elongated shell and adaptable to receive fastening means, and having an elongated shank tapering from said first end of said expansion wing to a second end adaptable to exit from said central exiting apertures in said elongated shell to engage the strata of the walls of said bolt hole, and means adaptable to receive the upper end of said threaded bolt; and fastening means to insert through said apertures of said second upper end of said elongated shell and said fastening apertures of said first end of said expansion wings and to engage and hold said expansion wings in position in said terminus of said elongated cavity of said elongated shell.

2. The invention of claim 1 wherein said expansion wings are of varying lengths and adaptable to be received in said interior cavity of said elongated shell.

3. The invention of claim 1 wherein the number of expansion wings is two, positioned in said terminus of said interior cavity to permit said expansion wings to exit from said exiting aperture to engage said walls of said bolt hold on opposite sides of said elongated shell.

4. The invention of claim 3 wherein said expansion wings are provided with multiple contacting tips for engaging the strata of said bolt hole.

5. The invention of claim 4 including a wedge cap for insertion between said threaded bolt and said expansion wings having a first end having a cavity adaptable to receive said threaded bolt and a wedge shaped thrustoconical second end for engaging said expansion wings.

6. The invention of claim 5 wherein said fastening means comprises flexible wire inserted through said apertures of said upper end of said elongated shell and said fastening apertures in said first of said expansion wings and attached to the outside of said elongated expansion shell.

7. The invention of claim 5 wherein said fastening means comprises a flexible mounting hood having a first end insertable into said fastening aperture of said first end of said expansion wing and extending out through said apertures of said upper end of said elongated shell to the outside thereof and adaptable to being bent over the outwide outer edge of said aperture of said second end of said elongated shell to retain said expansion wing in place.

8. The invention of claim 5 wherein said fastening means comprises a receiving slot in each of said first ends of said expansion wings adaptable to receive split head fastener means, and split head fastener means having a first end receivable by said receiving slots and an elongated flexible end extending vertically out through said vertical aperture to engage the outer surface of said elongated shell and retain said expansion wings in selected position in said terminus.

9. The invention of claim 1 wherein said interior cavity of said elongated shell includes a central threaded aperture extending from said first lower end of said elongated shell to a point in proximity to said terminus of said interior cavity having a channel therein adaptable to receive said expansion wings, and wherein said terminus of said interior cavity comprises a single receptacle adaptable to receive said first end of said expansion wings and wherein said first end of said expansion wings include a stud on opposite sides thereof to be received by said channel of said threaded portion.

10. The invention of claim 9 including wedge-shaped spacer means adaptable to be received between said expansion wings in said interior cavity having a first upper wedge-shaped end adaptable to be received in said interior cavity and to engage the lower side of said first end of said expansion wings and a second end adaptable to engage either said roof bolt or the upper wide of said first end of said expansion wings and including studs on opposite sides thereof adaptable to be received in said channel of said threaded portion of said interior cavity.

* * * * *